US011041374B2

(12) United States Patent
El-Mahbes et al.

(10) Patent No.: US 11,041,374 B2
(45) Date of Patent: Jun. 22, 2021

(54) BEAM PUMP GAS MITIGATION SYSTEM

(71) Applicant: Baker Hughes, a GE Company, LLC, Houston, TX (US)

(72) Inventors: Reda El-Mahbes, Houston, TX (US); Jordan Kirk, Tulsa, OK (US); Leslie Reid, Tulsa, OK (US); Jerry Ross, Tulsa, OK (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 0 days.

(21) Appl. No.: 16/365,540

(22) Filed: Mar. 26, 2019

(65) Prior Publication Data

US 2019/0292893 A1 Sep. 26, 2019

Related U.S. Application Data

(60) Provisional application No. 62/648,275, filed on Mar. 26, 2018.

(51) Int. Cl.

| | |
|---|---|
| ***E21B 43/38*** | (2006.01) |
| ***E21B 33/12*** | (2006.01) |
| ***E21B 43/12*** | (2006.01) |
| ***E21B 43/08*** | (2006.01) |
| ***E21B 47/06*** | (2012.01) |

(52) U.S. Cl.

CPC ..... *E21B 43/38* (2013.01); *E21B 33/12* (2013.01); *E21B 43/08* (2013.01); *E21B 43/128* (2013.01); *E21B 47/06* (2013.01)

(58) Field of Classification Search

CPC ..... E21B 33/12; E21B 43/08; E21B 43/128; E21B 43/38; E21B 47/06

See application file for complete search history.

(56) References Cited

U.S. PATENT DOCUMENTS

| | | | |
|---|---|---|---|
| 3,986,552 | A | 10/1976 | Scott |
| 5,433,269 | A | 7/1995 | Hendrickson |
| 5,660,533 | A | 8/1997 | Cartwright |
| 6,126,416 | A | 10/2000 | Lee |
| 6,186,227 | B1 | 2/2001 | Vaynshteyn et al. |
| 6,315,050 | B2 | 11/2001 | Vaynshteyn et al. |
| 6,564,876 | B2 | 5/2003 | Vaynshteyn et al. |
| 6,899,176 | B2 | 5/2005 | Hailey et al. |

(Continued)

FOREIGN PATENT DOCUMENTS

WO 2012169904 A2 12/2012

OTHER PUBLICATIONS

Written Opinion and Search Report for PCT Application PCT/US2019/024137, dated Jun. 20, 2019.

*Primary Examiner* — Omeed Alizada
(74) *Attorney, Agent, or Firm* — Crowe & Dunlevy, P.C.

(57) ABSTRACT

A gas mitigation system for use in connection with a subsurface pump includes a shroud hanger that has one or more orifices that permit the passage of fluids through the shroud hanger. A canister connected to the shroud hanger has an open upper end. An intake tube connected to the tubing string extends into the canister. The canister is sized and configured to cause fluids passing around the outside of the canister to accelerate, thereby encouraging the separation of gas and liquid components. The open shroud hanger and open upper end of the canister allow heavier liquid components to fall into the canister, where the liquid-enriched fluid can be drawn into the subsurface pump.

15 Claims, 4 Drawing Sheets

(56) References Cited

U.S. PATENT DOCUMENTS

| | | | |
|---|---|---|---|
| 7,387,158 | B2 | 6/2008 | Murray et al. |
| 7,552,777 | B2 | 6/2009 | Murray et al. |
| 8,322,450 | B2 | 12/2012 | Meijer |
| 8,998,586 | B2 | 4/2015 | Muhs |
| 9,447,661 | B2 | 9/2016 | Broussard et al. |
| 2002/0023750 | A1 | 2/2002 | Lopes et al. |
| 2004/0129432 | A1 | 7/2004 | Wills et al. |
| 2005/0199551 | A1 | 9/2005 | Gordon |
| 2005/0281683 | A1 | 12/2005 | Brown et al. |
| 2008/0093085 | A1 | 4/2008 | Knight et al. |
| 2008/0110614 | A1 | 5/2008 | Orban |
| 2009/0065202 | A1 | 3/2009 | Brown et al. |
| 2010/0206732 | A1 | 8/2010 | Hale |
| 2012/0057965 | A1 | 3/2012 | Bergamini et al. |
| 2013/0025865 | A1 | 1/2013 | Knobloch et al. |
| 2013/0075105 | A1 | 3/2013 | Morton |
| 2013/0306330 | A1 | 11/2013 | Bishop et al. |
| 2014/0332239 | A1 | 11/2014 | Porta |
| 2015/0053394 | A1 | 2/2015 | Reid et al. |
| 2015/0098840 | A1 | 4/2015 | Kowalchuk |
| 2015/0167652 | A1 | 6/2015 | Van et al. |
| 2015/0204158 | A1 | 7/2015 | Frisby et al. |
| 2015/0205158 | A1 | 7/2015 | Engel et al. |
| 2015/0275619 | A1 | 10/2015 | Slup |
| 2015/0345276 | A1 | 12/2015 | Jensen |
| 2016/0003031 | A1 | 1/2016 | Xin et al. |
| 2016/0130919 | A1 | 5/2016 | Vasques |
| 2016/0222770 | A1 | 8/2016 | Kirk et al. |
| 2017/0241215 | A1 | 8/2017 | Kleppa |
| 2017/0342798 | A1 | 11/2017 | Wutherich |
| 2018/0112509 | A1 | 4/2018 | Saponja et al. |
| 2018/0171763 | A1 | 6/2018 | Malbrel et al. |
| 2018/0179852 | A1 | 6/2018 | Hou et al. |
| 2018/0223642 | A1 | 8/2018 | Zahran |
| 2018/0298736 | A1 | 10/2018 | Bailey et al. |

BEAM PUMP GAS MITIGATION SYSTEM

RELATED APPLICATIONS

This application claims the benefit of U.S. Provisional Patent Application Ser. No. 62/648,275 filed Mar. 26, 2018 and entitled "Beam Pump Gas Mitigation System," the disclosure of which is herein incorporated by reference.

FIELD OF THE INVENTION

This invention relates generally to oilfield equipment, and in particular to surface-mounted reciprocating-beam, rod-lift pumping units, and more particularly, but not by way of limitation, to beam pumping units with systems for mitigating gas slugging.

BACKGROUND

Hydrocarbons are often produced from wells with reciprocating downhole pumps that are driven from the surface by pumping units. A pumping unit is connected to its downhole pump by a rod string. Although several types of pumping units for reciprocating rod strings are known in the art, walking beam style pumps enjoy predominant use due to their simplicity and low maintenance requirements.

In many wells, a high gas-to-liquid ratio ("GLR") may adversely impact efforts to recover liquid hydrocarbons with a beam pumping system. Gas "slugging" occurs when large pockets of gas are expelled from the producing geologic formation over a short period of time. Free gas entering a downhole rod-lift pump can significantly reduce pumping efficiency and reduce running time. System cycling caused by gas can negatively impact the production as well as the longevity of the system.

A number of gas handling technologies have been deployed in the past. These approaches are generally effective in low production wells with moderate gas fractions. However, the existing solutions have proven ineffective at managing elevated gas fractions in higher volume wells. There is, therefore, a need for an improved gas mitigation system for use in connection with a beam pump deployed in a high producing, elevated gas fraction well.

SUMMARY OF THE INVENTION

In one aspect, embodiments of the present invention include a gas mitigation system for use in connection with a subsurface pump that is configured to lift fluids through a tubing string contained in a well casing. The gas mitigation system includes a shroud hanger that has one or more orifices that permit the passage of fluids through the shroud hanger. A canister connected to the shroud hanger has an open upper end. An intake tube connected to the tubing string extends into the canister. The canister is sized and configured to cause fluids passing around the outside of the canister to accelerate, thereby encouraging the separation of gas and liquid components. The open shroud hanger and canister allow heavier liquid components to fall into the canister as they decelerate, where the liquid-enriched fluid can be drawn into the reciprocating subsurface pump.

In another aspect, the present invention provides a gas mitigation system for use in connection with a subsurface pump that is configured to lift fluids through a tubing string contained in a well having a well casing. The gas mitigation system includes a shroud hanger that includes one or more orifices that permit the passage of fluids through the shroud hanger. The gas mitigation system further includes a canister connected to the shroud hanger, where the canister has an open upper end. The gas mitigation system also includes an intake tube that extends into the canister and is in fluid communication with the subsurface pump. The gas mitigation further includes a tail pipe assembly that is connected to the canister. The tail pipe assembly is in fluid communication with the canister.

In yet another embodiment, the present invention includes a gas mitigation system for use in connection with a subsurface pump configured to lift fluids through a tubing string contained in a well having a well casing. The gas mitigation system has a shroud hanger that includes one or more orifices that permit the passage of fluids through the shroud hanger, and a canister connected to the shroud hanger, where the canister has an open upper end. The gas mitigation system further includes an intake tube in fluid communication with the subsurface pump. In this embodiment, the gas mitigation system includes a tail pipe assembly that is connected to the canister and a velocity tube connected to the tail pipe assembly. The tail pipe assembly is in fluid communication with the canister.

WRITTEN DESCRIPTION

Figure 1:
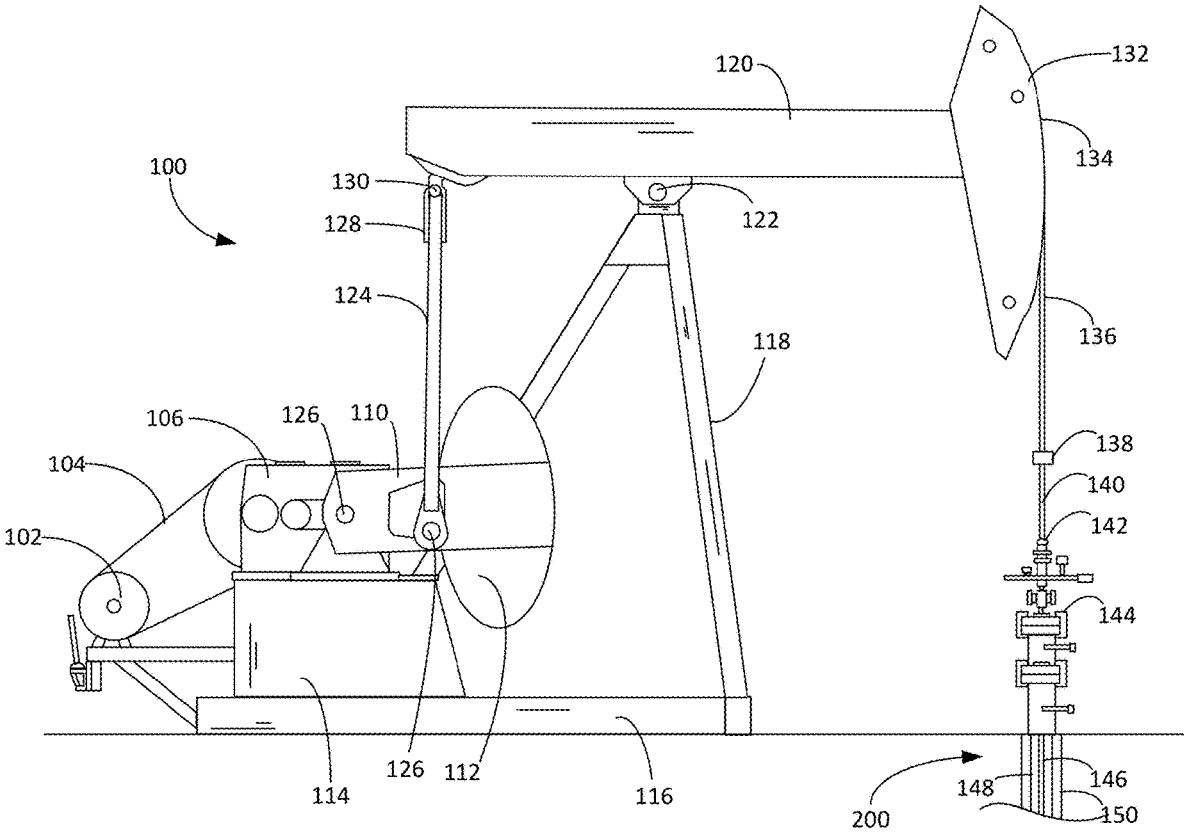
FIG. 1 is a side view of a beam pumping unit and well.

FIG. 1 shows a beam pump 100 constructed in accordance with an exemplary embodiment of the present invention. The beam pump 100 is driven by a prime mover 102, typically an electric motor or internal combustion engine. The rotational power output from the prime mover 102 is transmitted by a drive belt 104 to a gearbox 106. The gearbox 106 provides low-speed, high-torque rotation of a crankshaft 108. Each end of the crankshaft 108 (only one is visible in FIG. 1) carries a crank arm 110 and a counterbalance weight 112. The reducer gearbox 106 sits atop a sub-base or pedestal 114, which provides clearance for the crank arms 110 and counterbalance weights 112 to rotate. The gearbox pedestal 114 is mounted atop a base 116. The base 116 also supports a Samson post 118. The top of the Samson post 118 acts as a fulcrum that pivotally supports a walking beam 120 via a center bearing assembly 122.

Each crank arm 110 is pivotally connected to a pitman arm 124 by a crank pin bearing assembly 126. The two pitman arms 124 are connected to an equalizer bar 128, and the equalizer bar 128 is pivotally connected to the rear end of the walking beam 120 by an equalizer bearing assembly 130, commonly referred to as a tail bearing assembly. A horse head 132 with an arcuate forward face 134 is mounted to the forward end of the walking beam 120. The face 134 of the horse head 132 interfaces with a flexible wire rope bridle 136. At its lower end, the bridle 136 terminates with a carrier bar 138, upon which a polish rod 140 is suspended.

The polish rod 140 extends through a packing gland or stuffing box 142 on a wellhead 144 above a well 200. A rod string 146 of sucker rods hangs from the polish rod 140 within a tubing string 148 located within the well casing 150. The rod string 146 is connected to a plunger 147 and traveling valve 149 of a subsurface pump 151 (depicted in FIG. 3). In a reciprocating cycle of the beam pump 100, well fluids are lifted within the tubing string 148 during the rod string 146 upstroke. In accordance with well-established rod lift pump design, a stationary standing valve 153 and reciprocating traveling valve 149 cooperate to lift fluids to the surface through the tubing string.

Figure 2:
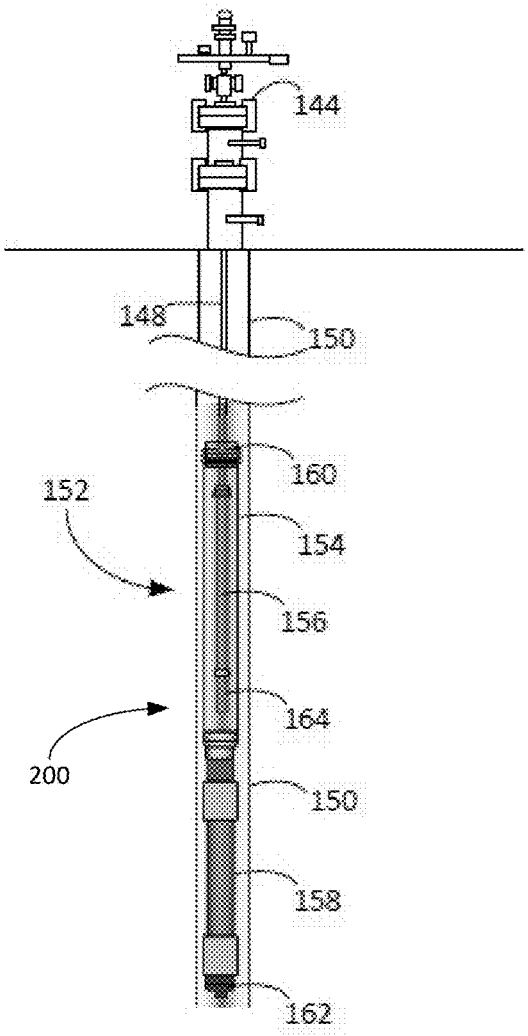
FIG. 2 is a depiction of a first embodiment gas mitigation system deployed in the well of FIG. 1.

Turning to FIG. 2, shown therein is a depiction of a gas mitigation system 152 deployed within the well casing 150. The gas mitigation system 152 includes a canister 154, an intake tube 156 positioned within the canister 154, and a tail pipe assembly 158 connected to the bottom of the canister 154. The canister 154 is suspended by a shroud hanger 160 that includes one or more orifices 161 that permit the flow of fluid from the wellbore into the canister 154 through an open upper end 163. An upper end of the tail pipe assembly 158 is connected to a bottom of the canister 154 and placed in fluid communication with an interior of the canister 154. A plug 162 secured to the lower end of the tail pipe assembly 158 seals a distal end of the tail pipe assembly 158.

Figure 3:
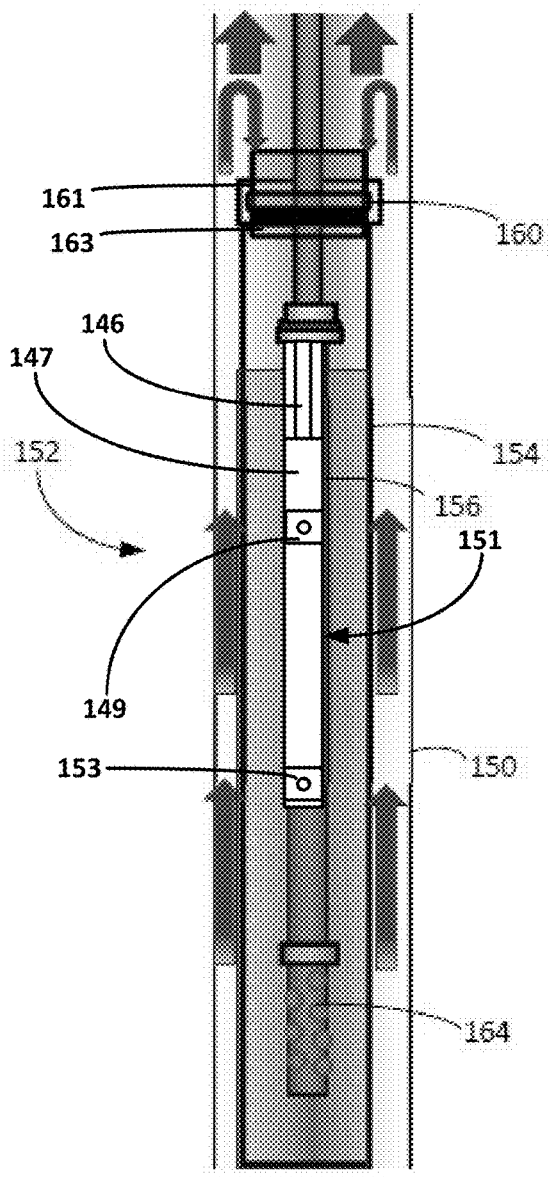
FIG. 3 is a close-up depiction of the can assembly of the gas mitigation system of FIG. 2.

The intake tube 156 is connected directly or indirectly to the tubing string 148 and extends through the shroud hanger 160. The intake tube 156 optionally includes an intake 164 that is a perforated joint with a sufficient number of perforations to provide unrestricted flow into the intake tube 156. The intake 164 optionally includes a screen or mesh cover that prevents larger solid particles from entering the intake tube 156. In some embodiments, the standing valve 153 and other components of the subsurface pump 151 are positioned within the intake tube 156 inside the canister 154 (as depicted in FIG. 3). The placement of the standing valve 153 in the canister 154 may assist with maximizing well drawdown. In other embodiments, the subsurface pump 151 is landed above the canister 154 and the intake tuber 156 extends down into the canister 154 to supply fluid to the subsurface pump 151 (as depicted in FIG. 4).

The canister 154 and tail pipe assembly 158 each have an outer diameter that provides a tight clearance with respect to the diameter of the well casing 150. In some embodiments, the cross-sectional width of the clearance is between about 2.5% to about 12% of the diameter of the well casing 150. For example, for a 7 inch well casing 150 the canister 154 can be sized to provide a clearance of between about 0.5 inches to about 0.83 inches. For a 5 inch well casing 150, the canister 154 can be sized such that it provides a clearance of between about 0.153 inches and 0.38 inches. The gas mitigation system 152 provides a larger clearance above the shroud hanger 160.

As noted in FIG. 3, the tight clearance between the gas mitigation system 152 and the well casing 150 causes wellbore fluids to accelerate as they pass by the gas mitigation system 152. A resulting reduction in the pressure of the fluid consistent with Bernoulli's principle assists with the separation of entrained gases from the liquids. Near the top of the gas mitigation system 152, the velocity of the liquids and gases rapidly decreases as the cross-sectional annular increases. As the fluids begin to decelerate, the separated heavier liquid components are encouraged to fall into the canister 154 through the shroud hanger 160, while the lighter gaseous components continue to rise in the annular space around the tubing string 148. Solid particles entrained in the liquid fall into the canister 154 and into the tail pipe assembly 158, where the particles are isolated and discouraged from entering the intake tube 156. This produces a liquid-enriched reservoir inside the canister 154, which can be drawn into the pump components through the intake tube 156. Thus, during large gas slugging events, the beam pump unit 100 can continue to operate efficiently using the liquid reserve contained in the gas mitigation system 152.

Figure 4:
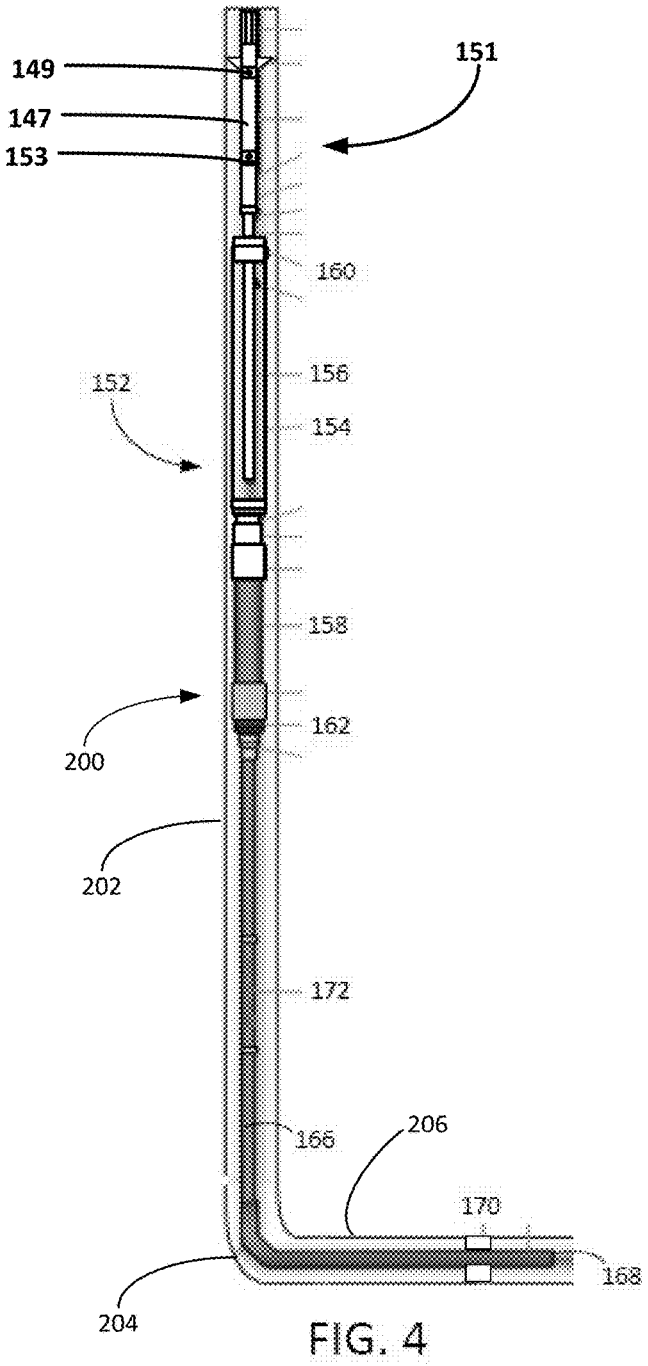
FIG. 4 is a depiction of a second embodiment of the gas mitigation system deployed in a deviated well.

Turning to FIG. 4, shown therein is a depiction of an embodiment of the gas mitigation system 152 deployed in a deviated (horizontal) well 200. In this embodiment, the gas mitigation system 152 further includes a velocity tube 166 that is connected to the plug 162 of the tail pipe assembly 158. The velocity tube 166 extends from a vertical portion 202 around a heel portion 204 into the lateral portion 206 of the well 200. The velocity tube 166 includes an open end 168 that permits the introduction of fluids into the velocity tube 166. A packer 170 or other wellbore isolation device can be used to prevent or reduce the movement of fluids in the annular space between the velocity tube 166 and the well casing 150. The velocity tube 166 includes a perforated joint 172 below the tail pipe assembly 158.

Figure 5:
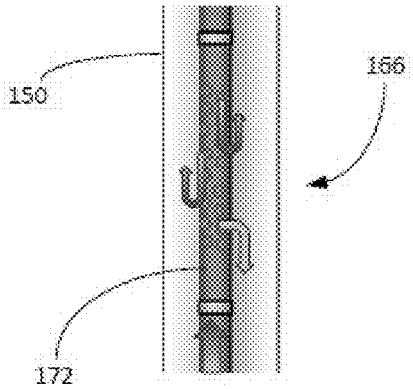
FIG. 5 is a close-up depiction of the solids separator from the second embodiment of the gas mitigation system of FIG. 4.

Fluids and entrained solids entering the open end 168 pass through the velocity tube 166 to the perforated joint 172. The fluids and solids are discharged at elevated velocities through the perforated joint 172 into the annular space between the velocity tube 166 and the well casing 150. As illustrated in FIG. 5, the heavier solid particles fall downward while the gas and liquid components rise toward the tail pipe assembly 158. In this way, the velocity tube 166 and perforated joint 172 of the gas mitigation system 152 cooperate to separate solid particles from the fluid stream before it approaches the canister 154.

Figure 6:
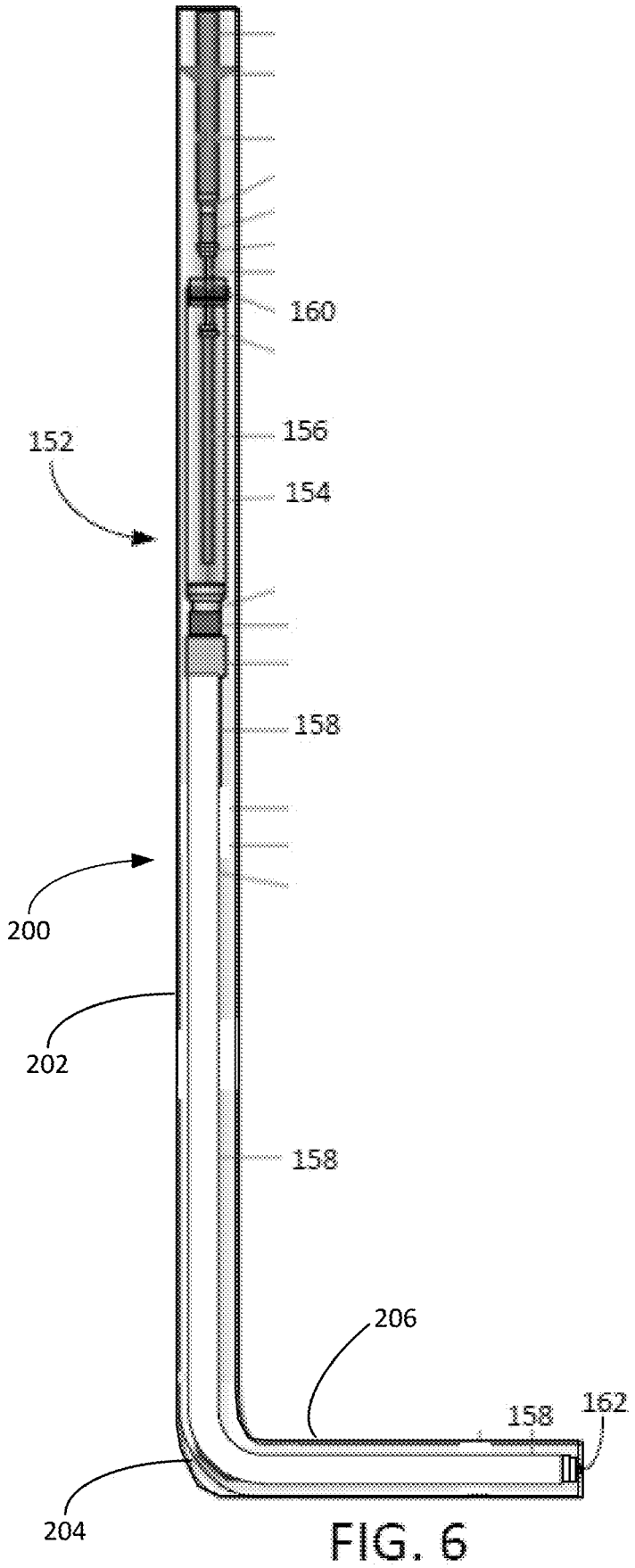
FIG. 6 is a depiction of a third embodiment of the gas mitigation system deployed in a deviated well.

In yet another embodiment, the gas mitigation system 152 includes an elongated tail pipe assembly 158. As depicted in FIG. 6, the elongated tail pipe assembly 158 extends into the heel portion 204 leading to the lateral section of the wellbore. The tail pipe assembly 158 may include flexible joints or be manufactured from an impermeable, flexible material that facilitates installation in unconventional wells. The elongated tail pipe assembly 158 has an outer diameter that provides a relatively tight clearance with the well casing 150. The reduced cross-sectional area of the annular space increases the velocity of fluids passing through the well casing 150 around the tail pipe assembly 158. The increased gas velocity provides a gas lift function that encourages the removal of liquids to the canister 154. The enlarged tail pipe assembly 158 and plug 162 also provide a larger container for isolating solid particles separated from fluids in the canister 154. The pressure in the annulus of the well casing 150 can be adjusted at the wellhead 144 to increase the gas lift function optimized by the elongated tail pipe assembly 158. In some embodiments, the elongated tail pipe assembly 158 terminates at about 10 to 20 degrees above a lateral axis extending through a lateral portion of the wellbore.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A gas mitigation system for use in connection with a subsurface pump configured to lift fluids through a tubing string contained in a well having a well casing, the gas mitigation system comprising:

a shroud hanger, wherein the shroud hanger includes one or more orifices that permit the passage of fluids through the shroud hanger;

a canister connected to the shroud hanger, wherein the canister has an open upper end;

an intake tube in fluid communication with the subsurface pump, wherein the intake tube extends into the canister;

a tail pipe assembly that is connected to the canister, wherein the tail pipe assembly is in fluid communication with the canister; and a velocity tube, wherein the velocity tube comprises a perforated joint connected to the tail pipe, and wherein the perforated joint permits the discharge of wellbore fluids and solids into an annular space between the velocity tube and the well casing.

2. The gas mitigation system of claim 1, wherein the subsurface pump includes a standing valve that is positioned inside the intake tube within the canister.

3. The gas mitigation system of claim 1, wherein the subsurface pump includes a standing valve that is positioned above the canister.

4. The gas mitigation system of claim 1, wherein the canister has an outer diameter, the well casing has an inner diameter, and an annular space between the outer diameter of the canister and the inner diameter of the well casing creates a clearance that has a cross-sectional width that is between about 2.5% to about 12% of the outer diameter of the well casing.

5. The gas mitigation system of claim 1, wherein the velocity tube comprises:

a packer disposed between the velocity tube and the well casing; and an open end on a first side of the packer, wherein the open end permits the introduction of wellbore fluids and solids into the velocity tube.

6. The gas mitigation system of claim 1, wherein the well has a vertical portion, a heel portion and a lateral portion, and wherein the velocity tube extends into the lateral portion of the well.

7. The gas mitigation system of claim 6, wherein the velocity tube extends above the heel portion about 10 to 20 degrees above a horizontal axis extending through the lateral portion.

8. A gas mitigation system for use in connection with a subsurface pump configured to lift fluids through a tubing string contained in a well having a well casing, the gas mitigation system comprising:

a shroud hanger, wherein the shroud hanger includes one or more orifices that permit the passage of fluids through the shroud hanger;

a canister connected to the shroud hanger, wherein the canister has an open upper end;

an intake tube in fluid communication with the subsurface pump, wherein the intake tube extends into the canister;

a tail pipe assembly that is connected to a bottom of the canister, wherein the tail pipe assembly is in fluid communication with the canister and configured to trap solid particles falling through the canister; and a velocity tube connected to the tail pipe assembly, wherein the velocity tube comprises:

a packer disposed between the velocity tube and the well casing;

an open end on a first side of the packer, wherein the open end permits the introduction of wellbore fluids and solids into the velocity tube; and a perforated joint on a second side of the packer, wherein the perforated joint permits the discharge of wellbore fluids and solids into an annular space between the velocity tube and the well casing.

9. The gas mitigation system of claim 8, wherein the subsurface pump includes a standing valve that is positioned inside the intake tube within the canister.

10. The gas mitigation system of claim 9, wherein the subsurface pump includes a standing valve that is positioned above the canister.

11. The gas mitigation system of claim 8, wherein the canister has an outer diameter, the well casing has an inner diameter and an annular space between the outer diameter of the canister and the inner diameter of the well casing creates a clearance that has a cross-sectional width that is between about 2.5% to about 12% of the outer diameter of the well casing.

12. The gas mitigation system of claim 8, wherein the well has a vertical portion, a heel portion and a lateral portion, and wherein the velocity tube extends into the lateral portion of the well.

13. A gas mitigation system for use in connection with a subsurface pump configured to lift fluids through a tubing string contained in a well having a well casing, the gas mitigation system comprising:

a shroud hanger, wherein the shroud hanger includes one or more orifices that permit the passage of fluids through the shroud hanger;

a canister connected to the shroud hanger, wherein the canister has an open upper end;

an intake tube in fluid communication with the subsurface pump, wherein the intake tube extends into the canister;

a tail pipe assembly that is connected to the canister, wherein the tail pipe assembly is in fluid communication with the canister; and a velocity tube connected to the tail pipe assembly, wherein the velocity tube comprises:

a packer disposed between the velocity tube and the well casing;

an open end on a first side of the packer, wherein the open end permits the introduction of wellbore fluids and solids into the velocity tube; and a perforated joint on a second side of the packer, wherein the perforated joint permits the discharge of wellbore fluids and solids into an annular space between the velocity tube and the well casing.

14. The gas mitigation system of claim 13, wherein the well has a vertical portion, a heel portion and a lateral portion, and wherein the velocity tube extends into the lateral portion of the well.

15. The gas mitigation system of claim 13, wherein the canister has an outer diameter, the well casing has an inner diameter and an annular space between the outer diameter of the canister and the inner diameter of the well casing creates a clearance that has a cross-sectional width that is between about 2.5% to about 12% of the outer diameter of the well casing.

* * * * *